US007721917B2

(12) United States Patent
Marone

(10) Patent No.: US 7,721,917 B2
(45) Date of Patent: May 25, 2010

(54) INTEGRATED WASHING AGENT DISPENSER, IN PARTICULAR FOR A DISHWASHER

(75) Inventor: Giuseppe Marone, Moncalieri (IT)

(73) Assignee: Elbi International S.p.A., Torino (IT)

( * ) Notice: Subject to any disclaimer, the term of this patent is extended or adjusted under 35 U.S.C. 154(b) by 622 days.

(21) Appl. No.: 10/599,891

(22) PCT Filed: Apr. 12, 2005

(86) PCT No.: PCT/EP2005/051604

§ 371 (c)(1),
(2), (4) Date: Oct. 12, 2006

(87) PCT Pub. No.: WO2005/099553

PCT Pub. Date: Oct. 27, 2005

(65) Prior Publication Data

US 2007/0215653 A1 Sep. 20, 2007

(30) Foreign Application Priority Data

Apr. 13, 2004 (IT) ..... TO2004A0226

(51) Int. Cl.
*B67D 3/00* (2006.01)

(52) U.S. Cl. ..... 222/129; 222/651; 222/504; 134/95.1

(58) Field of Classification Search ..... 222/129, 222/651, 504, 160; 134/93, 95.1
See application file for complete search history.

(56) References Cited

U.S. PATENT DOCUMENTS 3,827,600 A * 8/1974 Janke ..... 134/93
5,133,487 A * 7/1992 Russi ..... 222/651
7,047,987 B2 * 5/2006 Cerruti et al. ..... 134/93

FOREIGN PATENT DOCUMENTS

DE 3304037 A1 7/1984
DE 19535153 A1 3/1997

* cited by examiner

*Primary Examiner*—Kevin P Shaver
*Assistant Examiner*—Jonathan Wood
(74) *Attorney, Agent, or Firm*—Sughrue Mion, PLLC

(57) ABSTRACT

The device (1) can be used in particular for the pivotable door of a dishwasher and comprises, in a structure or body (2) a first dispenser device (5, 6) for a washing agent, and a second dispenser device (4) for rinse agent, an electrically controlled actuator device (20, 21) connected to the first dispenser device (5, 6) in such a way that when the door is closed, a first excitation of the actuator device (20, 21) causes substantially only washing agent to be dispensed, and connected to the second dispenser device (4) by means of a transmission mechanism (22, 23) which includes a pivotable interconnecting element (23). The interconnecting element (23) is able to make the mechanism (22, 23) inoperative when the door of the dishwasher is opened, and to make it operative after a first excitation of the actuator device (20, 21) after the door has been closed. One end (23*a*) of this interconnecting element (23) is pivoted directly onto a movable control member (18) of the second dispenser device (4).

7 Claims, 7 Drawing Sheets

INTEGRATED WASHING AGENT DISPENSER, IN PARTICULAR FOR A DISHWASHER

BACKGROUND OF THE INVENTION

The present invention relates to an integrated washing agent dispenser, in particular for the pivotable door of a dishwasher.

More specifically, the subject of the invention is a dispenser device comprising, within a support body or structure

- a first device for dispensing a washing agent and a second device for dispensing a rinse agent,
- an electrically controlled actuator device, coupled to the first dispenser device in such a way that a first commutation of the actuator device after the door has been closed dispenses substantially only the washing agent, and coupled to the second dispenser device by a transmission mechanism which includes a pivotable interconnecting element;
- the said interconnecting element being able to make the transmission mechanism inoperative when the door of the machine is opened and to make it operative after a first commutation of the actuator device subsequent to closure of the door.

Dispenser devices of this type are known in the art, for example from the documents DE 33 04 037-A and DE 195 35 153-A.

SUMMARY OF THE INVENTION

In these prior art devices, the aforesaid interconnecting element of the transmission mechanism is coupled to a movable member controlling the device for dispensing the rinse agent by means of a two-arm lever or rocker extending into the region between the rinse agent dispenser and the washing agent dispenser. In such devices the actuator is essentially constituted by an electromagnet, arranged at the rear part of the integrated dispenser device, behind the receptacle for detergent powder.

Prior art devices such as that described above have a relatively complicated transmission mechanism, the size of which limits the space available for the rinse agent receptacle. In addition, the fact that positioning the actuator behind the washing agent receptacle is practically unavoidable means that the integrated device is of considerable size, especially its thickness, in the portion forming the rinse agent dispenser.

One object of the present invention is thus to provide an integrated dispenser device which overcomes the limitations described above with regard to prior art devices.

This and other objects are achieved according to the invention by providing an integrated dispenser device of the type defined above, characterised in that one end of the said interconnecting element is pivoted directly onto a movable member controlling the second dispenser device.

BRIEF DESCRIPTION OF THE DRAWINGS

Further characteristics and advantages of the invention will become apparent from the detailed description which follows, provided purely by way of non-limitative example, with reference to the appended drawings, in which.

DETAILED DESCRIPTION OF THE INVENTION

Figure 1:
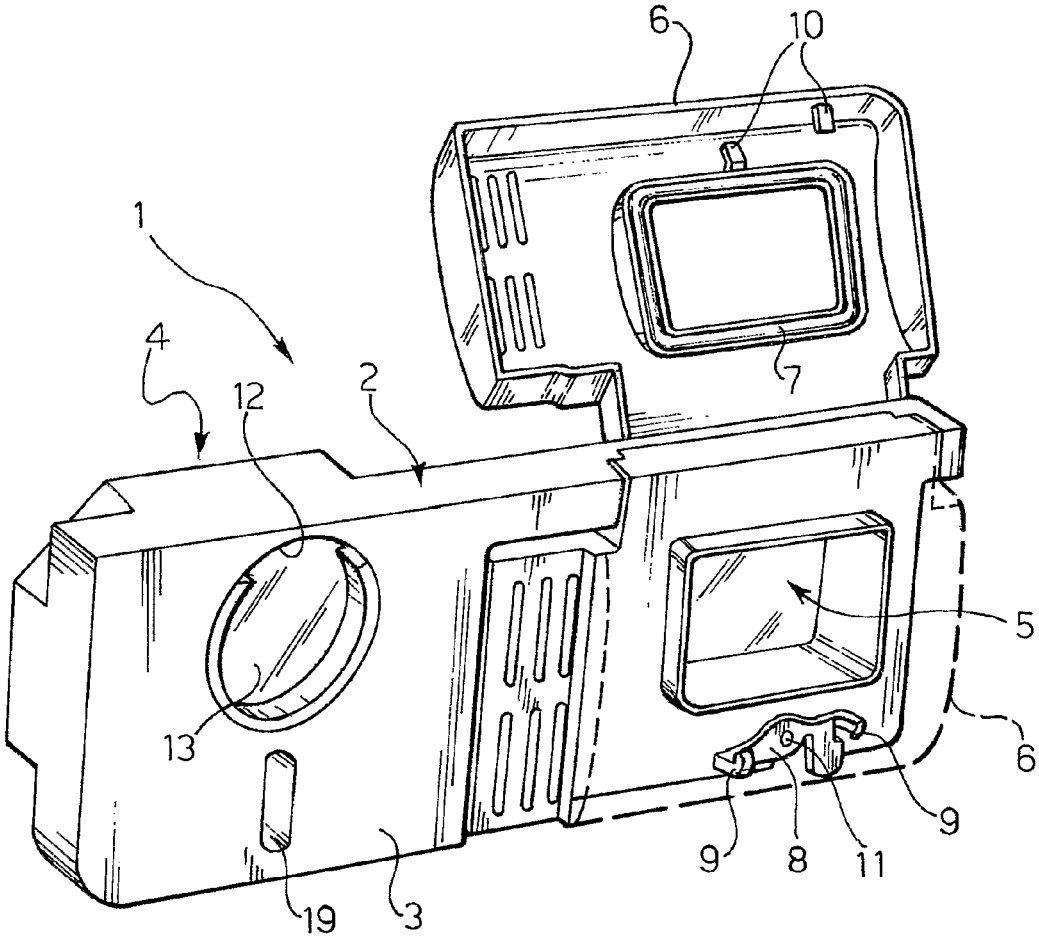
FIG. 1 is a perspective view of an integrated dispenser device according to the invention.

In the drawings, and in particular in FIG. 1, an integrated dispenser device according to the invention is generally indicated 1 and is intended to be fitted to the inside surface of the front door of a dishwasher.

The door of a dishwasher is usually hinged to the body of the machine along its bottom edge and can be opened into a substantially horizontal position (loading position) in order to place utensils needing washing in the washing chamber or to remove them after washing, and a vertical position (working position) in which the door closes the washing chamber, preventing any liquid from escaping during operation.

The integrated dispenser device 1 fitted to the door of a dishwasher is therefore also moved in operation between a horizontal loading position, in which it can be filled with detergent and rinse agent, and a vertical working position, in which the device faces into the washing chamber and is operable to dispense detergent and rinse agent, during the wash and rinse cycles respectively.

In the present description and in the appended Claims, the terms detergent or washing agent should be understood to mean any type of detergent or soap used in a dishwashing cycle. The term rinse agent should be understood to mean any product that can be used to improve the shine on clean items.

The integrated dispenser device 1 includes an elongate body 2 of a plastics material, to be fitted into a corresponding aperture provided in the door of a dishwasher.

The body 2 can be made in two parts for example, a main or front portion and an auxiliary or rear portion respectively, both produced by injection moulding and then connected together and heat welded using a hot blade device.

With reference to FIG. 1, a receptacle 5 for containing a quantity of detergent is formed in the front surface 3 of the body 2 which will face towards the washing chamber of the dishwasher.

A lid 6 is pivoted on the body 2, with a seal 7 fixed to its inside surface, for sealing the detergent receptacle 5 when the lid 6 is in the closed position shown by the broken line in FIG. 1. In a manner which is known per se and thus not shown, the lid 6 has an associated spring urging it into its open position, illustrated by a solid line in FIG. 1.

A rocker 8 is mounted for rotation on the front portion of the body 2, adjacent the receptacle 5, its two arms ending in hook members 9 operable to engage corresponding retaining members 10 provided in the lid 6 for holding it in its closed position.

Figure 2:
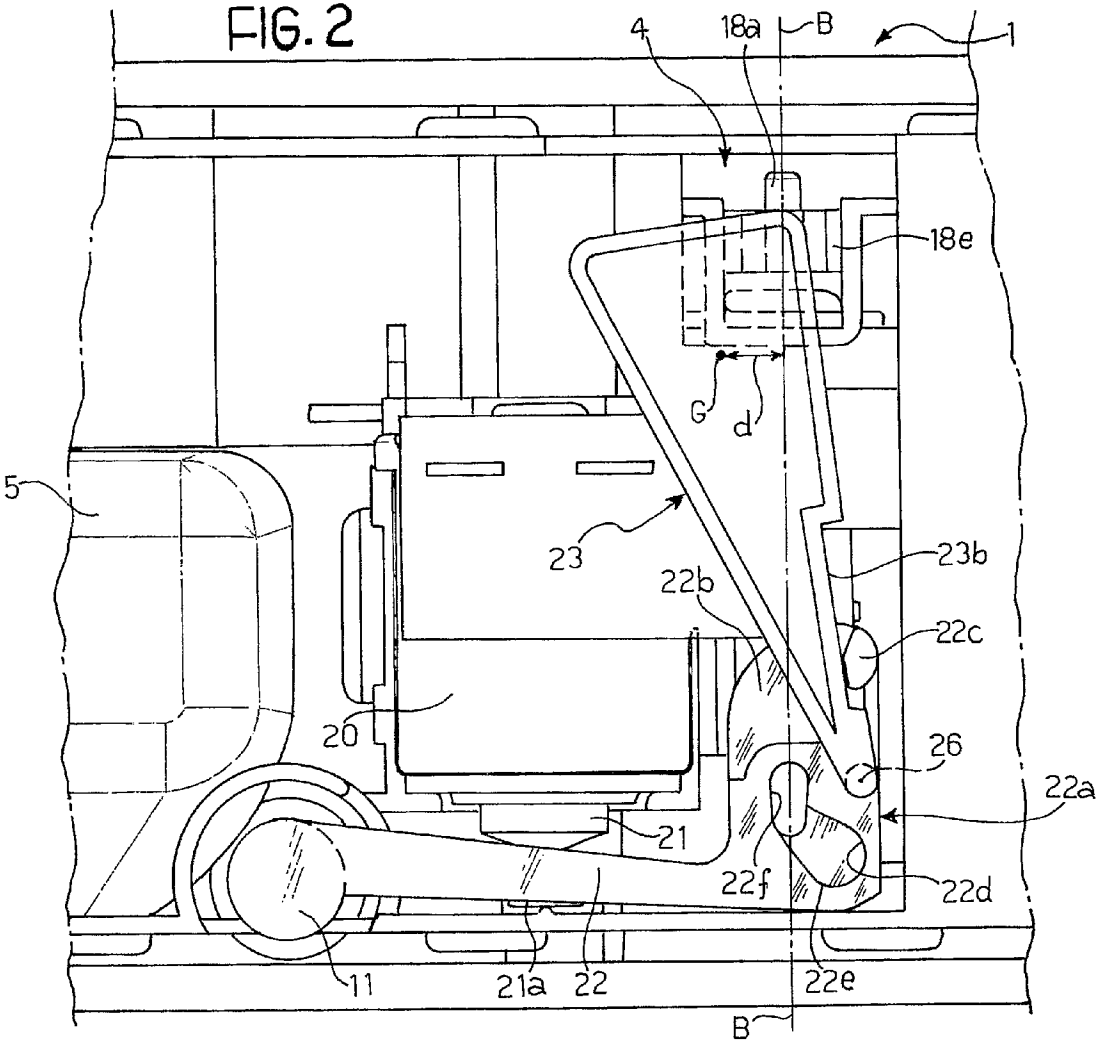
FIG. 2 is a rear elevation showing part of the dispenser device of FIG. 1, in a first condition.

The rocker 8 is mounted for rotation on a shaft 11 which passes through the body 2, projecting from the back of it, as seen for example in FIG. 2.

A dispenser for a rinse agent, generally indicated 4, is incorporated into the body 2 next to the detergent dispenser device 5, 6. In the embodiment shown by way of example, this device includes an essentially cylindrical seat 12, formed in the front portion of the body 2, with a rotatable dispenser device, generally indicated 13, arranged therein.

In the embodiment shown by way of example (see FIG. 6 in particular) the rinse agent dispenser 4 includes a dispenser chamber 14 with a delivery aperture 16 formed in its bottom surface 15 with an associated movable shutter 17. This shutter 17 is essentially tubular in shape, with a closed lower end which forms the shutter itself. A control rod 18 is force fitted into the tubular shutter, the upper end 18*a* thereof protruding upwardly into the rear portion of the body 2 of the integrated dispenser device, as shown for example in FIG. 2.

With reference once more to FIG. 6, the aperture 16 opens into an underlying duct 19 intended for conveying the rinse agent into the washing chamber of the dishwasher (see also FIG. 1).

On the rear of the body 2 of the dispenser device 1 (see FIG. 2), an electromagnetic actuator or electromagnet 20 is mounted in the area between the detergent receptacle 5 and the rinse agent dispenser 4, with a movable core 21 projecting from the bottom.

The lower end 21*a* of the core 21 is operatively coupled to a lever carried 22 by the shaft 11.

The distal end of the lever 22 has a shaped formation 22*a* with an upper projection 22*b* from which a stop projection 22*c* projects transversely (in the direction of the observer in FIG. 2) (see also FIG. 6), the function of which will be described later. In its lower portion, the formation 22*a* has a recess or cavity 22*d*, the bottom wall of which is indicated 22*e*. The upper, or upwardly facing portion of this wall 22*e* has a vertically elongate through aperture 22*f*.

With reference to FIGS. 2 to 7, an interconnecting element linking the lever 22 and the control member 18 of the shutter 17 of the rinse agent dispenser 4 is generally indicated 23. In the embodiment illustrated, the interconnecting element 23 is in the shape of a right-angled triangle. This shape is not compulsory however.

Figure 6:
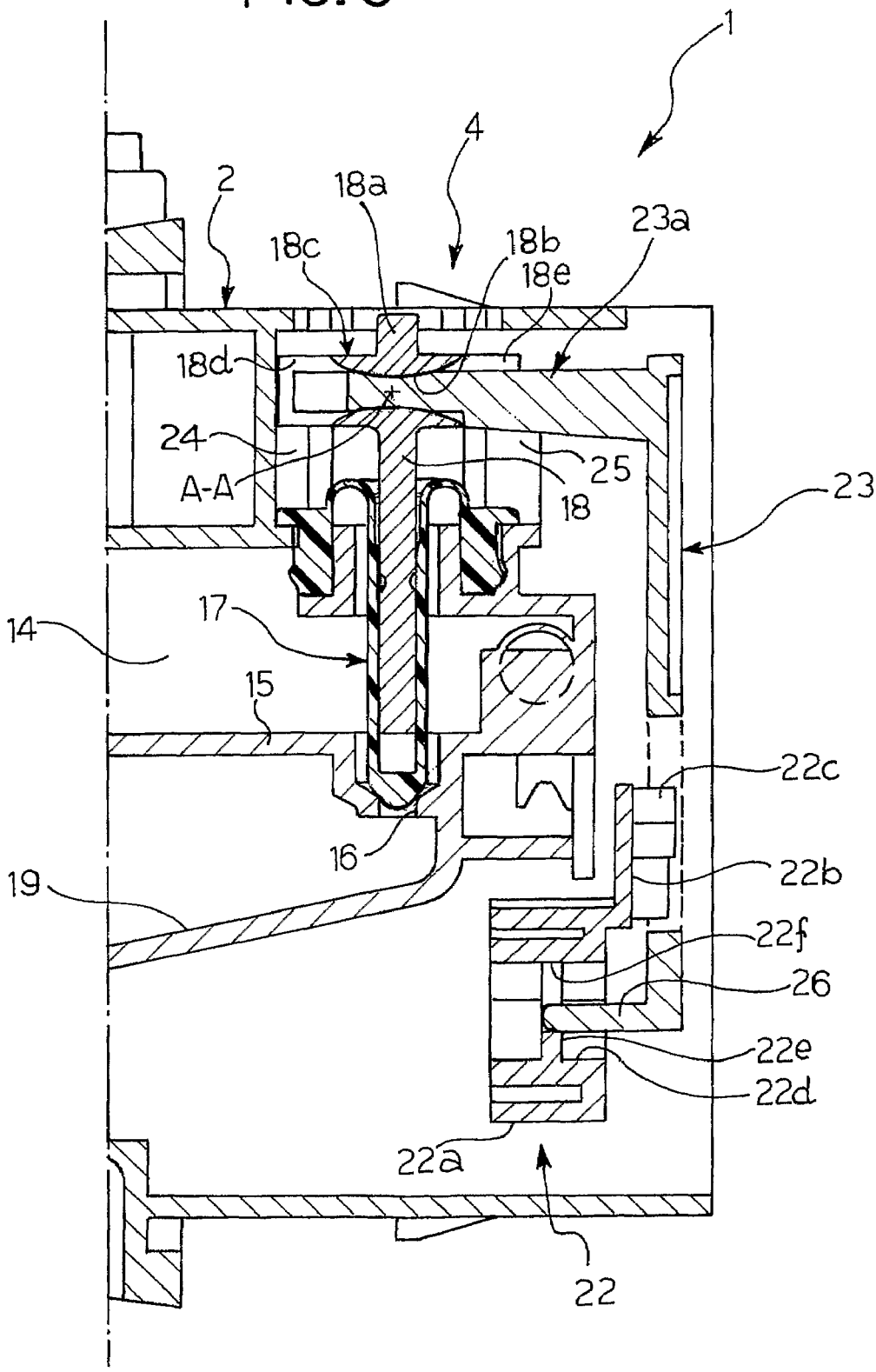
FIGS. 6 and 7 are sections taken on the lines VI-VI and VII-VII respectively of FIG. 5.
Figure 7:
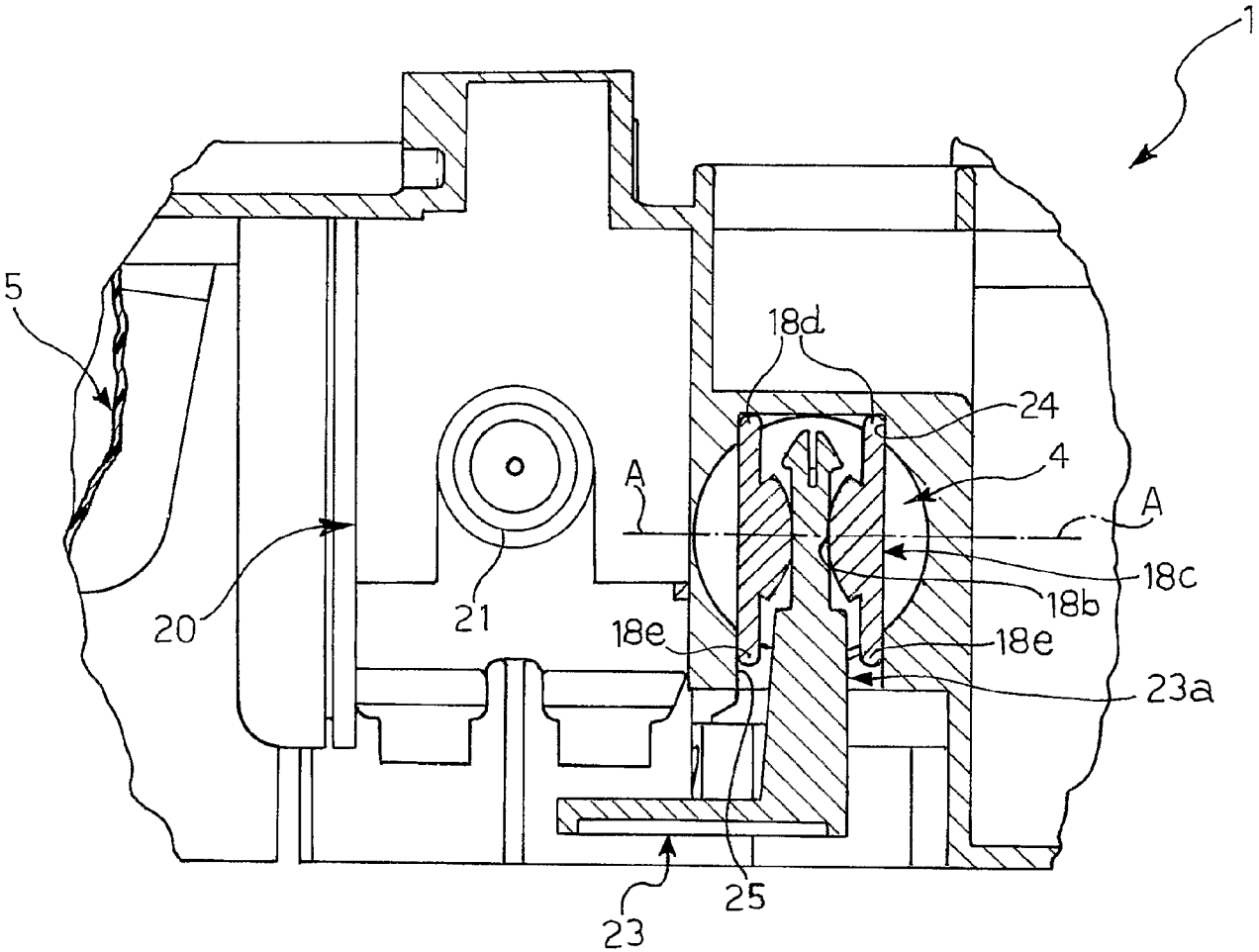

At the substantially right-angled tip of the element 23, an arm 23*a* projects from the surface thereof facing the body of the dispenser device 1 and is snap engaged in a passage 18*b* in a shaped formation 18*c* on the rod 18, near its end 18*a* (see FIGS. 6 and 7).

The shaped formation 18*c* has opposite terminal extensions 18*d* and 18*e*, slidably engaged in respective grooves 24 and 25 in the body 2 in such a way that the rod 18 can translate parallel to its longitudinal axis but is prevented from rotating about this axis.

The transverse passage 18*d* in the formation 18*a* on the rod 18 is such that when the projection or arm 23*a* of the interconnecting element 23 is held therein it is able to oscillate both about the longitudinal axis of the rod 18 and about a transverse axis, indicated A-A in FIG. 7.

With reference to FIGS. 2 to 5, the longer side forming the right angle of the interconnecting element 23 has a rientrant portion 23*b* whereby it rests against the stop projection 22*c* on the lever 22 under the force of gravity.

With reference to FIG. 2, it will be noted that the centre of gravity of the interconnecting element 23, indicated G, is spaced by a distance d from the vertical plane B-B containing the axis about which the interconnecting element 23 pivots about the control rod 18 of the rinse aid device dispenser 4. The interconnecting element 23 therefore tends naturally to pivot, anticlockwise as viewed looking at FIG. 2, and bear against the stop 22*c* on the control arm 22.

A transverse projection or pin, indicated 26 in FIGS. 2 to 6, extends from the surface of the element 23 facing the body 2 of the integrated dispenser 1, at the corner formed by the longer side and the hypotenuse.

In the operating condition shown in FIG. 2 (dishwasher door closed but actuator not yet excited following this closure), the feeler pin 26 on the interconnecting element 23 bears against the outer surface of the control lever 22, outside the recess 22*d* and the adjacent through aperture 22*f* (see FIGS. 2 and 6).

The dispenser device described above operates substantially in the manner which will be described next with reference to FIGS. 2 to 6.

It is assumed that the door of the dishwasher is initially open, that a quantity of detergent powder is placed in the receptacle 5 and that the associated lid is then closed and clipped to the rocker 8. It is also assumed that a plurality of doses remains in the rinse agent dispenser.

With the dishwasher door open, gravity causes the interconnecting element 23 to be positioned in such a way that the feeler pin or projection 26 is disengaged from the terminal shaped formation 22*a* on the control lever 22.

When the dishwasher door is closed, the dispenser device 1 moves into the position illustrated in FIG. 2: gravity causes the interconnecting element 23 to bear against the stop 22*c*, with its feeler pin 26 against the side surface of the control lever 22 outside the recess 22*e* and the through hole 22*f*.

Once the dishwasher is started, when it is time for the detergent in the receptacle 5 to be delivered into the washing chamber, the control unit of the appliance excites the electromagnetic actuator 20 for a first time. The core 21 thereof is "sucked" upwards, causing the control lever 22 and the associated shaft 11 to pivot from the position shown in FIG. 2 to the position shown in FIG. 3. This pivoting of the shaft 11 causes a corresponding pivoting of the rocker 8 resulting in the lid 6 being released and, under the action of the associated resilient means, moving into the position shown in FIG. 1, thereby opening the receptacle 5 and allowing the detergent contained therein to fall into the washing chamber.

Figure 3:
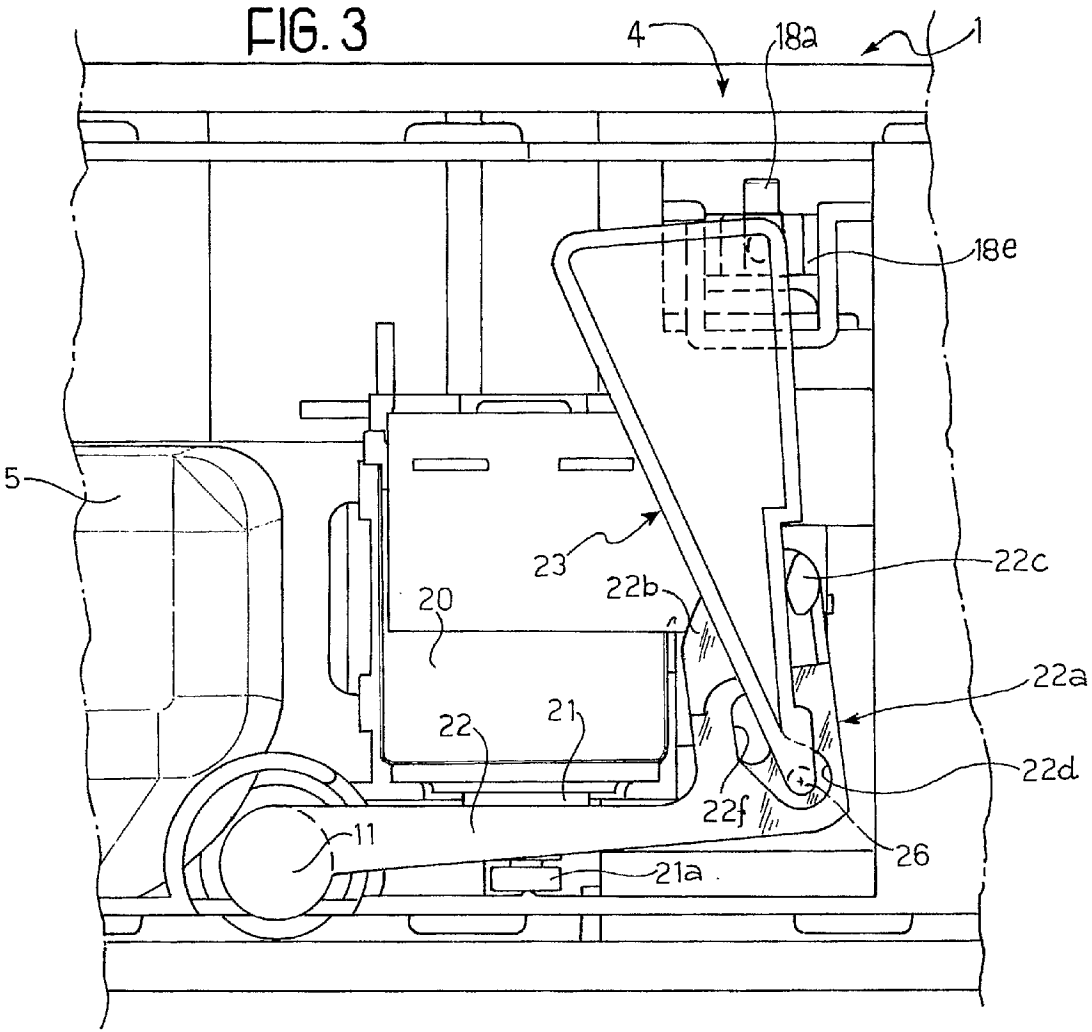
FIGS. 3 to 5 are similar views to that of FIG. 2, showing the dispenser device in successive operating conditions.

With reference to the passage from FIG. 2 to FIG. 3, it should be observed that, thanks to the effect of gravity, the interconnecting element 23 remains in contact with the stop 22*c* on the control lever 22, as a result of the rotation of this lever 22, the pin 26 on the interconnecting element 23 "drops" into and engages the recess 22*d* in the terminal formation 22*a* on the lever 22.

Figure 4:
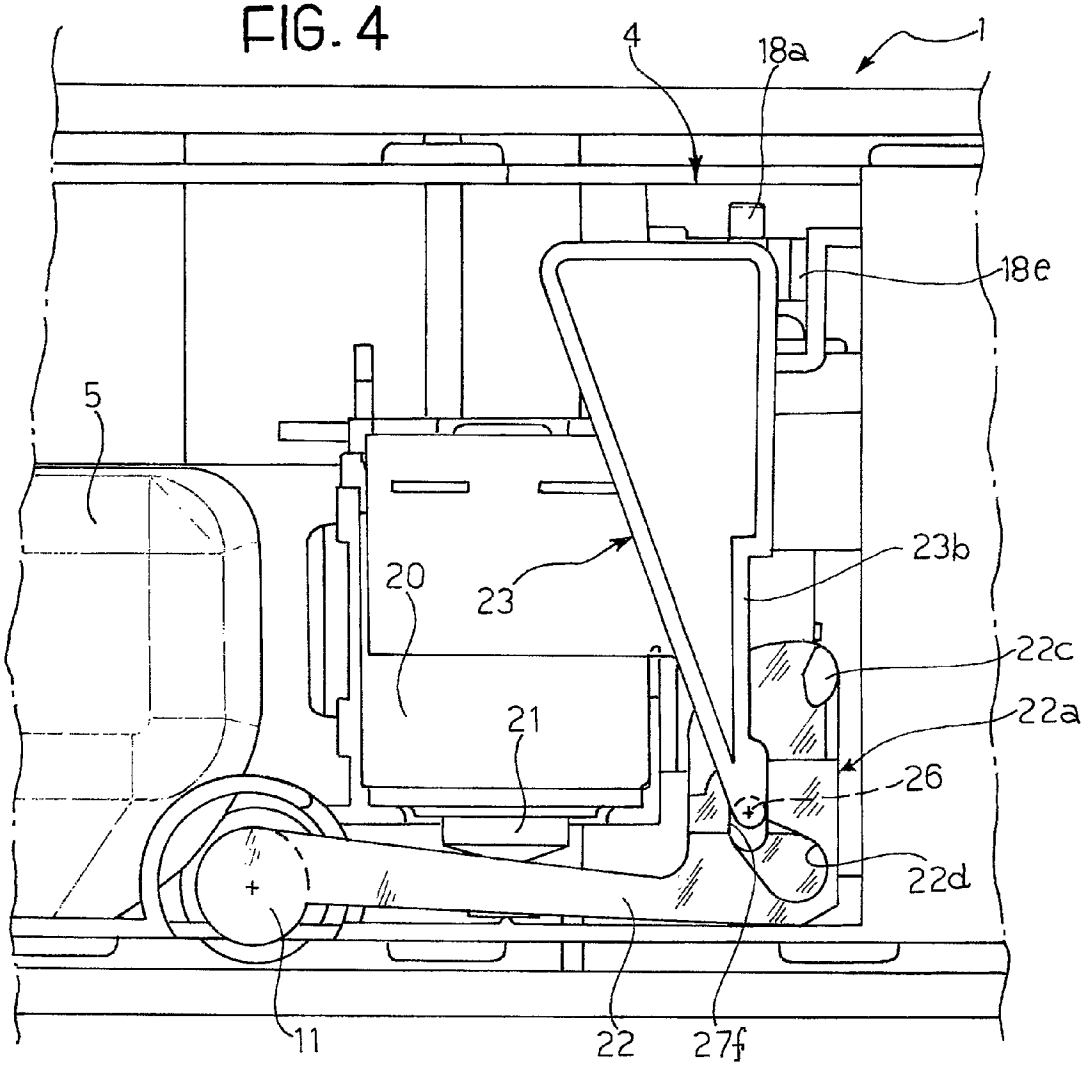

As soon as the electromagnetic actuator 20 is de-energized, the device moves from the condition shown in FIG. 3 to that shown in FIG. 4. With reference to this last drawing, the movable core 21 of the electromagnetic actuator 20 moves back into its initial position, thereby returning the lever 22 and the shaft 11 to their starting positions. The rotation of the lever 22 from the position of FIG. 3 to that of FIG. 4 causes the feeler pin 26 of the interconnecting element 23 to be positioned facing the aperture 22*f* in the terminal formation 22*a* of the lever 22 and to drop by gravity into this aperture. Since the pin 26 is held in the aperture 22*f*, the interconnecting element 23 remains spaced from the stop projection 22*c*.

Figure 5:
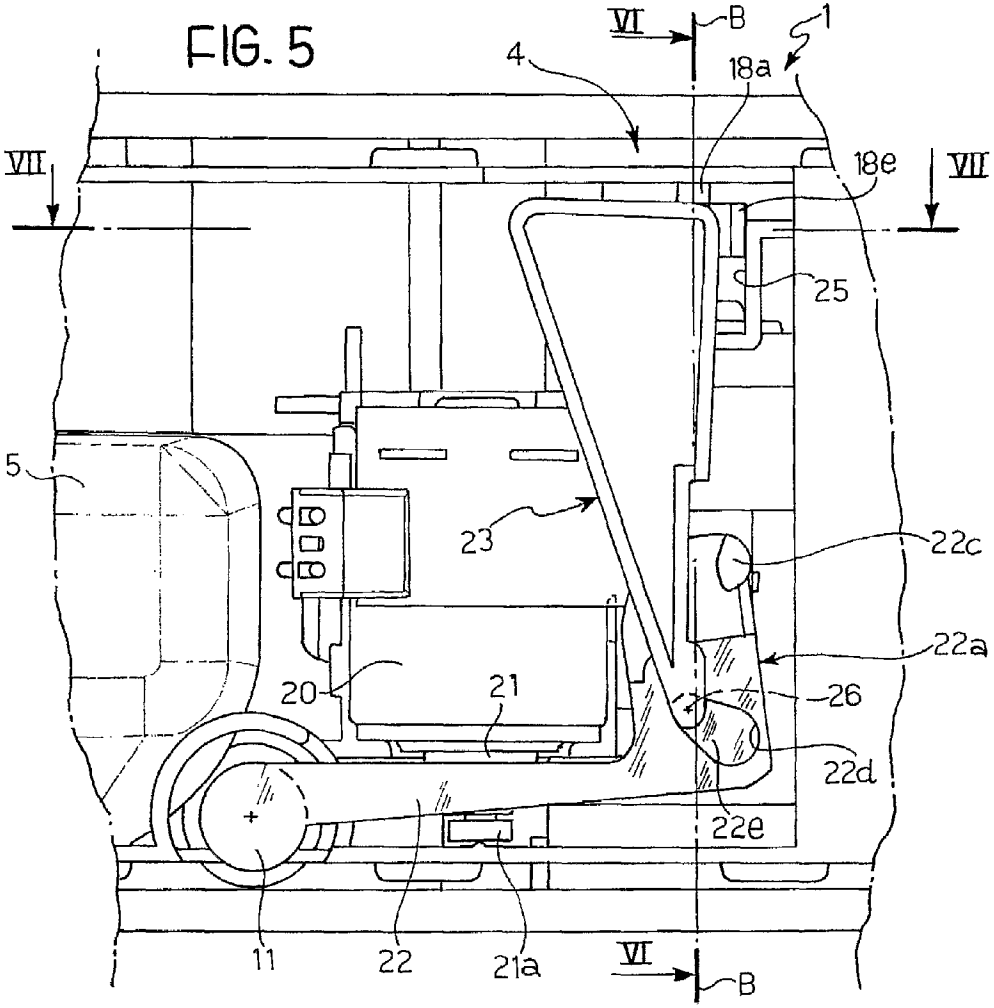

As the wash cycle continues, when it is time to release a dose of rinse agent, the control unit of the appliance excites the electromagnetic actuator 20 for a second time, causing the dispenser device 1 to move from the condition shown in FIG. 4 to that shown in FIG. 5.

The control lever 22 rotates anti-clockwise, and after rotating freely at first the lower edge of the aperture 22*f* encounters the feeler pin 26, moving it and the entire interconnecting element 23 upwards, causing a corresponding upward movement of the control rod 18 associated with the shutter 17. This shift causes the end portion of the shutter 17 to move away from the associated aperture or seat 16, allowing the rinse agent to flow from the dispenser chamber 14 into the delivery duct 19.

Once the rinse agent has been dispensed, the electromagnetic actuator 20 is again de-energized and the dispenser device 1 as a whole returns to the condition shown in FIG. 4. As the wash cycle continues, it is possible to dispense additional doses of rinse agent, by re-energizing the electromagnetic actuator 20 and causing the dispenser device 1 to move once again from the condition of FIG. 4 to that shown in FIG. 5.

On completion of the wash cycle, when the door of the dishwasher is opened, the interconnecting element 23 disengages again under the effect of gravity from the shaped terminal formation 22*a* of the control lever 22.

When the door is re-closed, operation resumes in the manner described above.

It is clear from the aforesaid operating description that if the door of the dishwasher is opened and then closed again during a wash cycle, the dispenser device 1 still returns to the condition shown in FIG. 2.

It should also be noted that the control lever 22 and the interconnecting element 23 together form a transmission mechanism linking the electromagnetic actuator 20 and the rinse agent dispenser 4, and that this mechanism becomes inoperative when the door of the appliance is opened, returning to its operating condition after the actuator device is first excited upon closing the door and then remaining inoperative for as long as the door remains closed.

In the arrangement according to the present invention, the electromagnetic actuator 20 is conveniently arranged between the receptacle 5 for the detergent or washing agent and the rinse agent dispenser 4. This makes it possible to reduce the depth of the dispenser device 1 as a whole in the area of the detergent receptacle 5. In addition, the transmission mechanism between the electromagnetic actuator 20 and the rinse agent dispenser 4 is made simpler, since it has no two-arm lever, such as those of the prior art devices.

Naturally, the principle of the invention remaining unchanged, embodiments and manufacturing details can vary widely from those described and illustrated purely by way of non-limitative example, without departing thereby from the scope of the invention as claimed in the appended Claims.

The invention claimed is:

1. An integrated dispenser device (1), in particular for a pivotable door of a dishwasher, comprising, in a structure or body (2)

a first dispenser device (5, 6) for washing agent and a second dispenser device (4) for a rinse agent, an electrically controlled actuator device (20, 21), connected to the first dispenser device (5, 6) in such a way that when the door is closed, a first excitation of the actuator device (20, 21) causes substantially only the washing agent to be dispensed, and connected to the second dispenser device (4) by means of a transmission mechanism (22, 23) including a pivotable interconnecting element (23), in such a way that when the door is closed a second excitation of the actuator device causes the rinse agent to be dispensed;

the said interconnecting element (23) acting to make the said mechanism (22, 23) inoperative when the door of the appliance is open and to make said mechanism operative after a first excitation of the actuator device (20, 21) once the door is closed;

wherein the said pivotal interconnecting element (23) has one end (23*a*) which is pivoted directly onto a movable control member (18) of the second dispenser device (4).

2. A device according to claim 1, in which the said transmission mechanism (22, 23) includes a control lever (22) mounted rotatably in the said structure or body (2), and the position of which is controlled in operation by the actuator device (20, 21), the said control lever (22) being a single arm lever, rotatable about an axis (11) passing through the end thereof which is opposite the rinse agent dispenser device (4) with respect to the actuator device (20, 21).

3. A device according to claim 2, in which the said control lever has a shaped portion (22*a*), with a blind recess (22*d*) and an adjacent through aperture (22*f*), and in which the interconnecting element (23) has a pin-like projection (26) at one end, the said projection cooperating in use with the recess (22*d*) and the said through aperture (22*f*) in the control lever (22).

4. A device according to claim 2, in which the said control lever (22) has a stop projection (22*c*) against which the interconnecting element (23) abuts by gravity until the actuator device (20, 21) is de-energized for the first time after the door of the appliance has been closed.

5. A device according to claim 1, in which the movable control member (18) of the second dispenser device (4) is mounted inside the said structure or body (2) for translation along its own axis but without being rotatable about this axis.

6. An integrated dispenser device (1), in particular for a pivotable door of a dishwasher, comprising, in a structure or body (2)

a first dispenser device (5, 6) for washing agent and a second dispenser device (4) for a rinse agent, an electrically controlled actuator device (20, 21), connected to the first dispenser device (5, 6) in such a way that when the door is closed, a first excitation of the actuator device (20, 21) causes substantially only the washing agent to be dispensed, and connected to the second dispenser device (4) by means of a transmission mechanism (22, 23) including a pivotable interconnecting element (23);

the said interconnecting element (23) acting to make the said mechanism (22, 23) inoperative when the door of the appliance is open and to make said mechanism operative after a first commutation of the actuator device (20, 21) once the door is closed;

wherein the said interconnecting element (23) has one end (23*a*) which is pivoted directly onto a movable control member (18) of the second dispenser device (4);

wherein said transmission mechanism (22, 23) includes a control lever (22) mounted rotatably in the said structure or body (2), and the position of which is controlled in operation by the actuator device (20, 21), the said control lever (22) being a single arm lever, rotatable about an axis (11) passing through the end thereof which is opposite the rinse agent dispenser device (4) with respect to the actuator device (20, 21); and wherein said control lever (22) has a stop projection (22*c*) against which the interconnecting element (23) abuts by gravity until the actuator device (20, 21) is de-energized for the first time after the door of the appliance has been closed.

7. An integrated dispenser device (1), in particular for a pivotable door of a dishwasher, comprising, in a structure or body (2)

a first dispenser device (5, 6) for washing agent and a second dispenser device (4) for a rinse agent, an electrically controlled actuator device (20, 21), connected to the first dispenser device (5, 6) in such a way that when the door is closed, a first excitation of the actuator device (20, 21) causes substantially only the washing agent to be dispensed, and connected to the second dispenser device (4) by means of a transmission mechanism (22, 23) including a pivotable interconnecting element (23);

the said interconnecting element (23) acting to make the said mechanism (22, 23) inoperative when the door of the appliance is open and to make said mechanism operative after a first commutation of the actuator device (20, 21) once the door is closed;

wherein the said interconnecting element (23) has one end (23*a*) which is pivoted directly onto a movable control member (18) of the second dispenser device (4); and wherein the movable control member (18) of the second dispenser device (4) is mounted inside the said structure or body (2) for translation along its own axis but without being rotatable about this axis.

* * * * *